US006155701A

United States Patent [19]

Leen

[11] Patent Number: 6,155,701

[45] Date of Patent: Dec. 5, 2000

[54] SECURITY LIGHT WITH TWO-PIECE SUPPORT

[76] Inventor: Monte A. Leen, 1804 W. Lake Sammamish Pkwy. NE., Bellevue, Wash. 98008

[21] Appl. No.: 09/150,871

[22] Filed: Sep. 10, 1998

[51] Int. Cl.[7] ..... F21V 21/10

[52] U.S. Cl. ..... 362/432; 362/431; 362/370; 362/404; 362/414; 362/410; 362/413; 362/450

[58] Field of Search ..... 362/432, 370, 362/404, 431, 414, 410, 413, 450

[56] References Cited

U.S. PATENT DOCUMENTS 4,152,757 5/1979 Bilson et al. ..... 362/432

4,551,793 11/1985 Mellema ..... 362/370

*Primary Examiner*—Stephen Husar
*Assistant Examiner*—Anabel M. Ton
*Attorney, Agent, or Firm*—Dean A. Craine

[57] ABSTRACT

A security light comprising a mercury vapor lamp (13), a two-piece support arm (11), and a mounting bracket (17) is disclosed. The two-piece support arm includes a 90-degree arcuate section (33) and a straight section (35), which are disassemblable for shipping. When assembled, the mounting bracket (17) is located on one end (41) of the 90-degree arcuate section (33). The other end (39) of the 90-degree arcuate section (33) telescopes inside one end (37) of the straight section (35). The mercury vapor lamp (13) is mounted on the other end of the straight section (35).

2 Claims, 2 Drawing Sheets

SECURITY LIGHT WITH TWO-PIECE SUPPORT

FIELD OF THE INVENTION

This invention relates to security lights and, more particularly, to security light support systems.

BACKGROUND OF THE INVENTION

Security lights are widely used in commercial, residential, and other environments to light darkened areas in order to improve security. One common type of security light is a mercury vapor lamp mounted on the end of a support arm that includes a mounting bracket for mounting the support arm to a vertical surface.

While mercury vapor lamps and other types of security lights that include a lamp mounted on the end of a support arm are widely used and well known, such security lights have a disadvantage that makes them difficult to package and ship. More specifically, in the past, security lights with support arms have usually been formed of two large components that are disassembled for shipping—a lamp and a support arm. The lamp comprises a housing and a suitable light source, e.g., a source of mercury vapor light housing. The support arm may include an integral or separate mounting bracket. The mounting bracket may be separated from the support arm for shipment purposes. If separate, the packing and shipping difficulty arises because, in the past, the support arm, which is generally elongate, is difficult to pack with the lamp the support arm is designed to support. The lamp, which usually includes a stubby arm, a lamp base, and a lens or shade, is normally short and fat. In contrast, as noted above, the support arm is elongate. The elongate dimension is usually twice or more the largest of the length, width, and height dimensions of the lamp. Because of the dissimilarity between the shape of the lamp and the support arm, security light packing and shipping costs have been greater than desired.

The present invention is directed to providing a security light that includes a lamp and a support arm that is less expensive to package for shipment than prior art security lights formed of lamps and support arms.

SUMMARY OF THE INVENTION

In accordance with this invention, a security light comprising a lamp, preferably a mercury vapor lamp, a two-piece support arm, and a mounting bracket is provided. The two-piece support arm includes a 90-degree arcuate section and a straight section which are disassemblable for shipping. When assembled, the mounting bracket is located on one end of the arcuate section. One end of the elongate section is attached to the other end of the arcuate section. The lamp is mounted on the other end of the straight section.

In accordance with further aspects of this invention, the arcuate and straight sections telescopingly join together.

In accordance with other aspects of this invention, a bolt passes through the telescoping connection between the straight and arcuate sections.

As will be readily appreciated from the foregoing description, the disassemblable two-piece support arm greatly improves the ease of packaging a security light formed in accordance with the invention. Rather than requiring a relatively large box or container to house both an elongate two-piece support and a short and fat lamp, a much smaller container sized to receive a disassembled two-piece support arm and a short and fat lamp can be utilized, decreasing packaging and distribution costs.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figure 1:
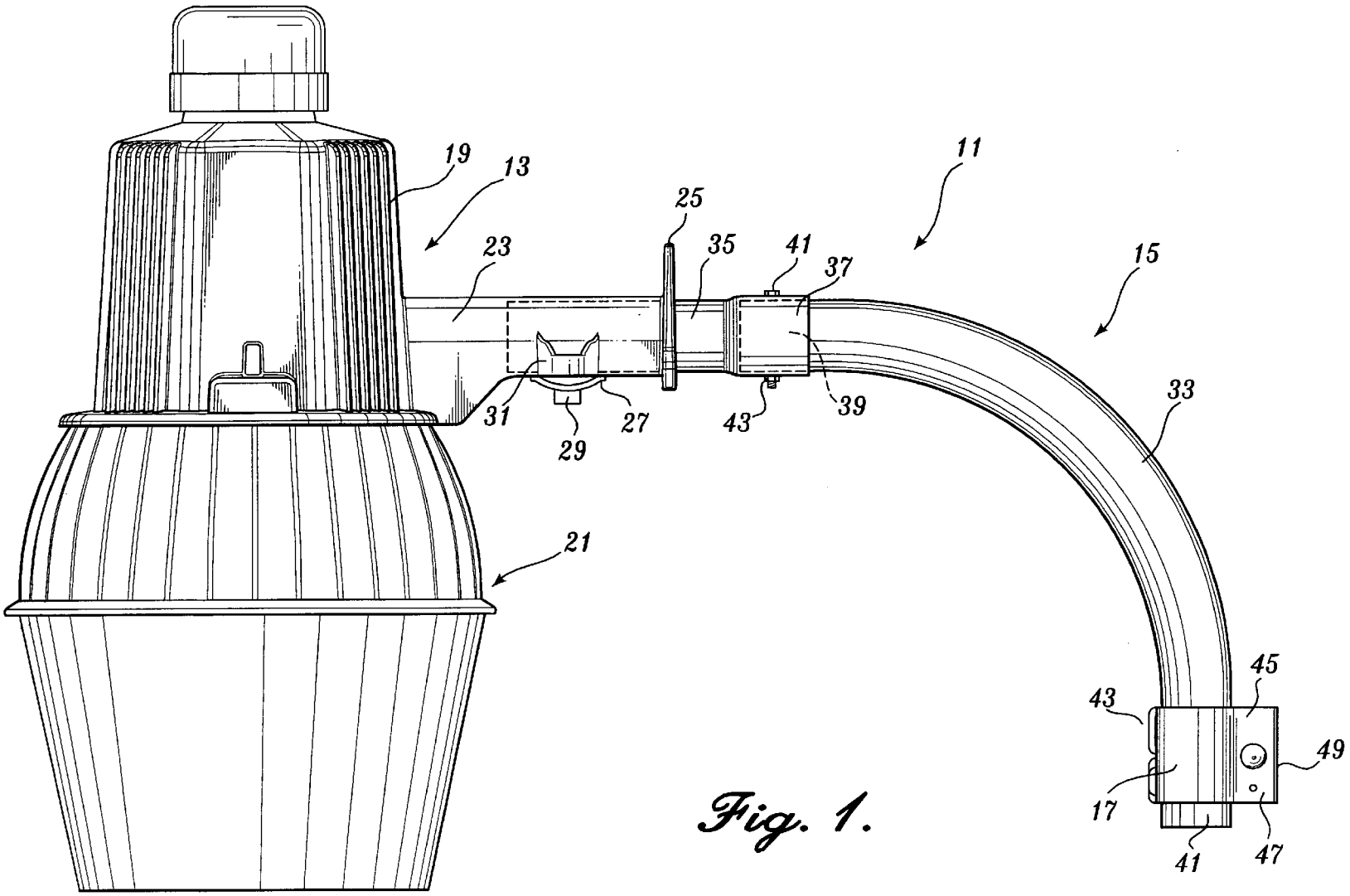
FIG. 1 illustrates a security light with a two-piece support formed in accordance with the present invention.
Figure 2:
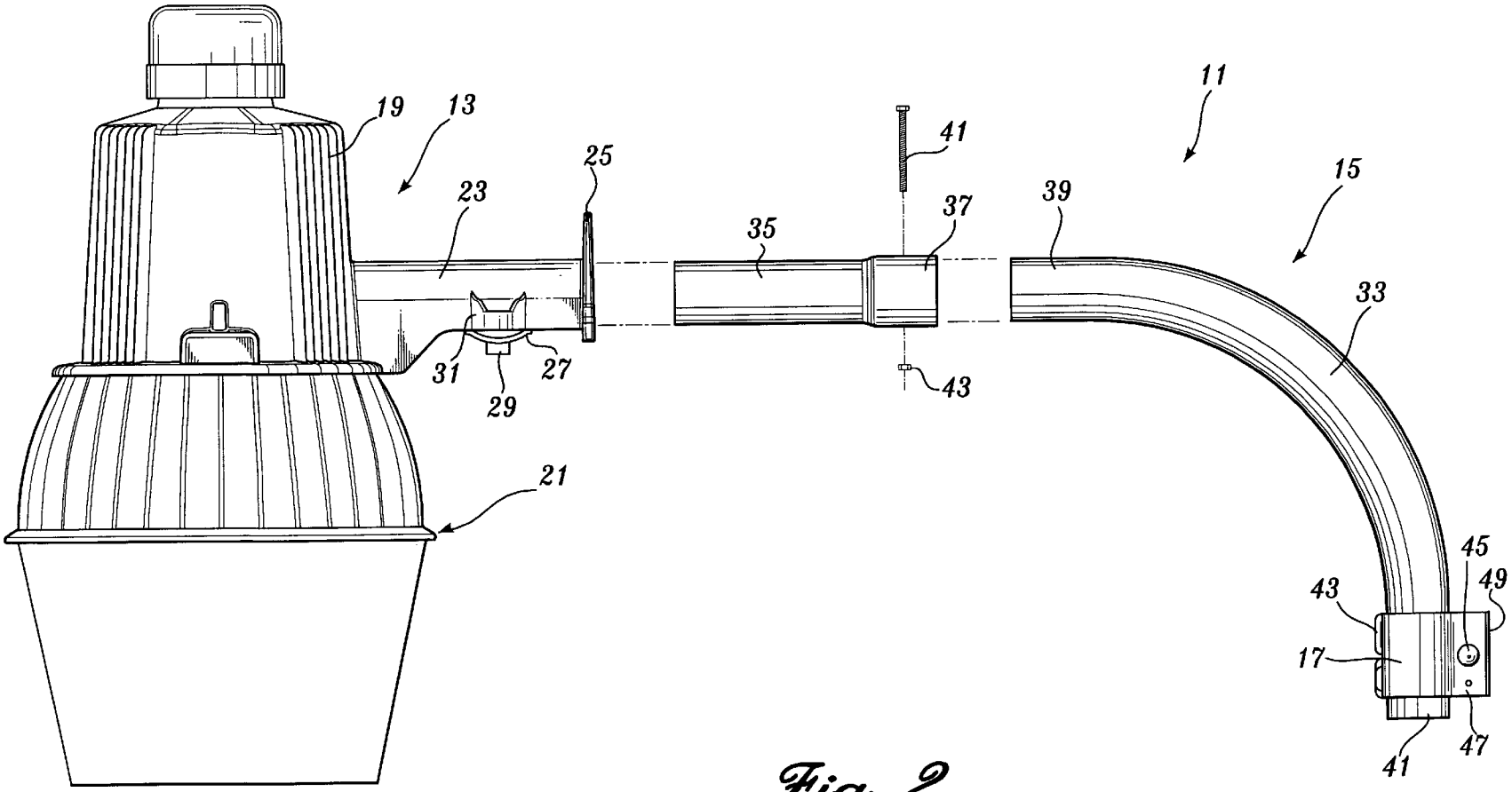
FIG. 2 is an exploded view of the security light illustrated in FIG. 1.

FIGS. 1 and 2 illustrate a security light 11 formed in accordance with this invention. The security light 11 illustrated in FIGS. 1 and 2 includes a mercury vapor lamp 13, a two-piece support arm 15, and a mounting bracket 17.

The mercury vapor lamp 13 is a conventional mercury vapor lamp well known to those familiar with security lights that includes a housing and a source of mercury vapor light. The mercury vapor light housing includes a base 19, which houses a receptacle and wiring for a mercury vapor light, and a shade 21. The base 19 is usually cast from a suitable metal, i.e., aluminum, and the shade is usually formed of thin aluminum or some other suitable material. Extending outwardly from the base 19 is an arm 23 that is integrally formed with the base 19. The outer end of the arm 23 includes a flange 25. The lower or bottom side of the arm 23 is open. The opening is closed by a compression plate 27 and a pair of attachment bolts 29, one located on either end of the plate and threaded into a bracket 31 that is integrally formed with the arm 23.

The two-piece support arm 15 includes a 90-degree arcuate section 33 and a straight section 35. One end 37 of the straight section 35 is enlarged so as to receive one end 39 of the 90-degree arcuate section in a telescoping manner. After being telescoped together, a bolt 41 is inserted through aligned holes (not shown) in the telescoped-together sections and threaded into a nut 43. The other end of the straight section 35 is inserted into the arm 23 of the base 19 of the mercury vapor lamp 13. Thereafter, the plate 27 is installed, the bolts 29 are inserted into the brackets 31, and the bolts are tightened to rigidly attach the mercury vapor lamp 13 to the outer end of the straight section 35 as illustrated in FIG. 1.

The bracket 17 surrounds the other end 41 of the 90-degree arcuate section 33 in a rigid manner. More specifically, the bracket 17 includes two arcuate sections that are interwoven together along one end 43. A bolt 45 passes through flanges 47 that extend outwardly from the arcuate sections of the bracket 17 opposite the interwoven end 43. The arcuate sections surround the other end 43 of the 90-degree arcuate section. Tightening the bolt 45 creates a pressure that rigidly attaches the bracket 17 to the 90-degree arcuate section 33. The bracket 17 also includes orthogonal flanges 49 that project outwardly from the flanges 47. The orthogonal flanges are suitable for placement against a vertical surface and attachable thereto by bolts or other attachment mechanisms (not shown).

As will be readily appreciated from the foregoing description, a security light formed in accordance with the invention includes a lamp and a two-piece support arm that is easily disassemblable for packing during transportation between a manufacturing site and an end user via normal distribution channels. Because the support arm is disassemblable, packaging costs and, thus, distribution costs are significantly reduced when compared to security lights distributed with a single-piece support arm sized similar to the size of a two-piece support arm of the type illustrated in FIGS. 1 and 2.

While a preferred embodiment of the invention has been illustrated and described, it will be appreciated that within the scope of the appended claims various changes can be made therein without departing from the spirit and scope of the invention. For example, the invention can be used with various types of lamps other than the mercury vapor lamps illustrated in FIGS. 1 and 2. Further, the straight and arcuate sections can be joined in ways other than telescoping. Also, the straight section can be joined to the lamp in other ways. Hence, within the scope of the appended claims it is to be understood that this invention can be practiced otherwise than as specifically described herein.

What is claimed:

1. In a security light comprising a light housing, a support arm and a mounting bracket, the improvement comprising:

a two-piece support arm including a straight section and a 90-degree arcuate section, said straight section being telescopingly joined and connected at one end to said light housing and said arcuate section being telescopingly joined and connected to the opposite end of said straight section; and, said mounting bracket being selectively connected to the end of said 90 degree arcuate section opposite said straight section to connect said 90 degree arcuate section to a support surface.

2. The improvement claimed in claim 1, including a bolt for fixing said 90-degree arcuate section and said straight section together when said straight section and said 90-degree arcuate section are telescopingly joined together.

* * * * *